United States Patent [19]

Gregory et al.

[11] Patent Number: 4,808,568

[45] Date of Patent: Feb. 28, 1989

[54] THERMAL TRANSFER PRINTING

[75] Inventors: Peter Gregory, Bolton; Roy Bradbury, Farnworth, both of England

[73] Assignee: Imperial Chemical Industries PLC, London, England

[21] Appl. No.: 46,187

[22] Filed: May 5, 1987

[30] Foreign Application Priority Data

May 27, 1986 [GB] United Kingdom ..... 8612668

[51] Int. Cl.[4] ..... B41M 5/035; B41M 5/26

[52] U.S. Cl. ..... 503/227; 8/471; 428/195; 428/913; 428/914

[58] Field of Search ..... 8/470, 471; 428/195, 428/913, 914; 503/227

[56] References Cited

U.S. PATENT DOCUMENTS

| | | | |
|---|---|---|---|
| 3,905,951 | 9/1975 | Berrie et al. | 260/156 |
| 4,015,934 | 4/1977 | Liechti et al. | 8/614 |
| 4,614,521 | 9/1986 | Niwa et al. | 8/471 |
| 4,664,671 | 5/1987 | Gregory | 8/655 |

FOREIGN PATENT DOCUMENTS

| | | | |
|---|---|---|---|
| 2159971 | 12/1985 | United Kingdom | 503/227 |

OTHER PUBLICATIONS

Patent Abstracts of Japan, vol. 9, No. 152 (1985) JP.A-6027594.

*Primary Examiner*—Bruce H. Hess

*Attorney, Agent, or Firm*—Cushman, Darby & Cushman

[57] ABSTRACT

A thermal transfer printing sheet, suitable for use in a thermal transfer printing process, especially for the conversion of a digital image into a visible print, comprising a substrate having a coating comprising a dye of the formula:

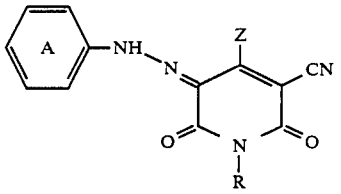

wherein

Ring A is unsubstituted or carries, in the 2- or 4-position with respect to the azo link, at least one group selected from $—CX_3$, $X^1$, CN, $NO_2$, —OCO.Y, —CO.Y, —CO.H, $—OSO_2.Y$ and $—SO_2.Y$, provided that A is substituted when Z is $CH_3$ and R is $C_{2-4}$-alkyl;

X & $X^1$ are each independently halogen;

Y is selected from $R^1$, $—OR^1$, $SR^1$ and $—NR^1R^2$;

$R^1$ is selected from $C_{1-12}$-alkyl, $C_{1-12}$-alkyl interrupted by one or two groups selected from —O—, —CO—, O.CO— and —CO.O—, $C_{3-7}$-cycloalkyl, mono- or bi-cyclic aryl and $C_{1-3}$-alkylene attached to an adjacent carbon atom on Ring A;

$R^2$ is selected from H, $C_{1-12}$-alkyl, $C_{3-7}$-cycloalkyl and mono- or bi-cyclic aryl;

Z is $C_{1-12}$-alkyl or phenyl; and

R is selected from $C_{2-12}$-alkyl unbranched in the alpha-position, $C_{2-12}$-alkyl unbranched in alpha-position and interrupted by one or two groups selected from —O—, —CO—, O.CO— and —CO.O—, phenyl, $C_{1-4}$-alkylphenyl, biphenyl and biphenyl interrupted by a group selected from —O—, —CO—, O.CO— and —CO.O—, each of which is free from hydrogen atoms capable of intermolecular hydrogen bonding.

9 Claims, No Drawings

THERMAL TRANSFER PRINTING

This specification describes an invention relating to thermal transfer printing (TTP), especially to a TTP sheet carrying a dye or dye mixture, to the dye mixture and to a novel dye.

In TTP a heat-transferable dye is applied to a sheet-like substrate in the form of an ink, usually containing a polymeric or resinous binder to bind the dye to the substrate, to form a transfer sheet. This is then placed in contact with the material to be printed, (generally a film of polymeric material such as a polyester sheet) hereinafter called the receiver sheet and selectively heated in accordance with a pattern information signal whereby dye from the selectively heated regions of the transfer sheet is transferred to the receiver sheet and forms a pattern thereon in accordance with the pattern of heat applied to the transfer sheet.

Important criteria in the selection of a dye for TTP are its thermal properties, brightness of shade, fastness properties, such as light fastness, and facility for application to the substrate in the preparation of the transfer sheet. For suitable performance the dye should transfer evenly, in proportion to the heat applied to the TTP sheet so that the depth of shade on the receiver sheet is proportional to the heat applied and a true grey scale of coloration can be achieved on the receiver sheet. Brightness of shade is important in order to achieve as wide a range of shades with the three primary dye shades of yellow, magenta and cyan. As the dye must be sufficiently mobile to migrate from the transfer sheet to the receiver sheet at the temperatures employed, 300°–400° C., it is generally free from ionic and water-solubilising groups, and is thus not readily soluble in aqueous or water-miscible media, such as water and ethanol. Many suitable dyes are also not readily soluble in the hydrocarbon solvents which are commonly used in, and thus acceptable to, the printing industry; for example, alcohols such as i-propanol, ketones such as methyl-ethylketone (MEK), methyl-i-butylketone (MIBK) and cyclohexanone and aromatic hydrocarbons such as toluene. Although the dye can be applied as a dispersion in a suitable solvent, it has been found that brighter, glossier and smoother final prints can be achieved on the receiver sheet if the dye is applied to the substrate from a solution. In order to achieve the potential for a deep shade on the receiver sheet it is desirable that the dye should be readily soluble in the ink medium. It is also important that a dye which has been applied to a transfer sheet from a solution should be resistant to crystallisation so that it remains as an amorphous layer on the transfer sheet for a considerable time.

The following combination of properties are highly desirable for a dye which is to be used in TTP:

Ideal spectral characteristics (narrow absorption curve with absorption maximum matching a photographic filter: for yellow dyes, a blue filter at 435±10 nm).

High tinctorial strength (extinction coefficient>40,000).

Correct thermochemical properties (high thermal stability and good transferability with heat).

High optical densities on printing.

Good solubility in solvents acceptable to printing industry: this is desirable to produce solution coated dyesheets.

Stable dyesheets (resistant to dye migration or crystallisation).

Stable printed images on the receiver sheet (to heat and especially light).

The achievement of good light fastness in TTP is extremely difficult because of the unfavourable environment of the dye, namely surface printed polyester on a white pigmented base. Many known dyes for polyester fibre with high light fastness (>6 on the International Scale of 1–8) on polyester fibre exhibit very poor light fastness (<3) in TTP.

The achievement of the desirable properties with yellow dyes is particularly difficult and the leading yellow dyes for the conventional transfer printing of polyester textile materials do not meet these criteria. For example, CI Disperse Yellow 3, an azophenol dye, does not have the correct spectral characteristics (too red and dull), has poor solubility (precludes solution coated dyesheets), is tinctorially weak (gives low optical density on printing) and has poor light fastness. CI Disperse Yellow 54, a quinophthalone dye which is probably the leading yellow dye for the conventional transfer printing of polyester textile materials, has very poor solubility which precludes its use for solution coated dyesheets.

It has now been found that certain azopyridone dyes have properties which render them more suitable for TTP than dyes which have previously been known or proposed for the heat transfer printing of textile materials.

The Invention

According to a first aspect of the present invention there is provided a thermal transfer printing sheet comprising a substrate having a coating comprising a dye of the formula:

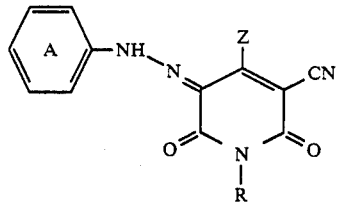

I wherein

Ring A is unsubstituted or carries, in the 2- or 4-position with respect to the azo link, at least one group selected from $—CX_3$, $X^1$, CN, $NO_2$, —OCO.Y, —CO.Y, —CO.H, $—OSO_2.Y$ and $—SO_2.Y$, provided that A is substituted when Z is $CH_3$ and R is $C_{2-4}$-alkyl;

X & $X^1$ are each independently halogen;

Y is selected from $R^1$, $—OR^1$, $SR^1$ and $—NR^1R^2$;

$R^1$ is selected from $C_{1-12}$-alkyl, $C_{1-12}$-alkyl interrupted by one or two groups selected from —O—, —CO—, O.CO— and —CO.O—, $C_{3-7}$-cycloalkyl, mono- or bi-cyclic aryl and $C_{1-3}$-alkylene attached to an adjacent carbon atom on Ring A;

$R^2$ is selected from H, $C_{1-12}$-alkyl, $C_{3-7}$-cycloalkyl and mono- or bi-cyclic aryl;

Z is $C_{1-12}$-alkyl or phenyl; and

R is selected from $C_{2-12}$-alkyl unbranched in the alpha-position, $C_{2-12}$-alkyl unbranched in alpha-position and interrupted by one or two groups selected from —O—, —CO—, O.CO— and —CO.O—, phenyl, $C_{1-4}$-alkylphenyl, biphenyl and biphenyl interrupted by a group selected from —O—, —CO—, O.CO— and —CO.O—, each of which is free from hydrogen atoms capable of intermolecular hydrogen bonding.

The Coating

The coating preferably comprises a binder and one or more dyes of Formula I. The ratio of binder to dye is preferably at least 1:1 and more preferably from 1.5:1 to 4:1 in order to provide good adhesion between the dye and the substrate and inhibit migration of the dye during storage.

The coating may also contain other additives, such as curing agents, preservatives, etc., these and other ingredients being described more fully in EP 133011A, EP 133012A and EP 111004A.

The Binder

The binder may be any resinous or polymeric material suitable for binding the dye to the substrate which has acceptable solubility in the ink medium, i.e the medium in which the dye and binder are applied to the transfer sheet. Examples of binders include cellulose derivatives, such as ethylhydroxyethylcellulose (EHEC), hydroxypropylcellulose (HPC), ethylcellulose, methylcellulose, cellulose acetate and cellulose acetate butyrate; carbohydrate derivatives, such as starch; alginic acid derivatives; alkyd resins; vinyl resins and derivatives, such as polyvinyl alcohol, polyvinyl acetate, polyvinyl butyral and polyvinyl pyrrolidone; polymers and co-polymers derived from acrylates and acrylate derivatives, such as polyacrylic acid, polymethyl methacrylate and styrene-acrylate copolymers, polyester resins, polyamide resins, such as melamines; polurea and polyurethane resins; organosilicons, such as polysiloxanes, epoxy resins and natural resins, such as gum tragacanth and gum arabic.

It is however preferred to use a binder which is soluble in one of the above-mentioned commercially acceptable organic solvents. Preferred binders of this type are EHEC, particularly the low and extra-low viscosity grades, and ethyl cellulose.

The Dye of Formula I

Formula I is written in the hydrazone tautomeric form because the dye is believed to exist in this form (see Lycka and Machacek, in Dyes and Pigments 1986, 171).

It is preferred that the Ring A carries 1 or 2 substituents and that one of these groups is in the 4 position with respect to the azo link. Where there is a single substituent this is preferably in the 2 or 4 position, and where there are two substituents these are preferably in the 2 and the 4 positions. In the substituents on A, it is preferred that X is fluorine and $X^1$ is chlorine or fluorine. It is also preferred that $R^1$ and $R^2$ are each independently selected from $C_{1-8}$-alkyl, phenyl, $C_{1-4}$-alkylphenyl, methylene, and a chain of two or more alkyl groups, especially two or three $C_{1-4}$-alkyl groups, carrying a total of up to 12 carbon atoms linked by —O— groups. Where $R^1$ is alkylene, especially methylene, the substituent on A is preferably —CO.$OCH_2$— and comprises a fused lactone ring attached to Ring A at the 3 and 4 positions with respect to the azo link.

Examples of substituents on Ring A are F; Cl; Br; —$CF_3$; —$NO_2$; —CN; —CO.O—$C_{1-4}$-alkyl, especially —CO.$OC_2H_5$; —CO.$C_{1-4}$-alkyl, especially —CO.$CH_3$; —CO.H; —CO.PH; —CO.$SC_{1-4}$-alkyl, especially —CO.$SC_2H_5$; —CO.$OC_2H_4OCH_3$; —CO.$OC_2H_4OC_2H_4OCH_3$, —CO.OCh; —CO—$N(C_4H_9)_2$, —$OSO_2$.Ph, —$SO_2$.OPh; —$SO_2$.NH.$C_8H_{17}$, —$OSO_2$.$N(CH_3)_2$, —CO.$OCH_2$-furyl and 4-(i-$C_3H_7$)PhCO—, in which Ph is phenyl and Ch is cyclohexyl. Specific examples of Ring A are 4-chloroPh, 2-chloroPh, 4-fluoroPh, 2-fluoroPh, 4-chloro-2-trifluoromethylPh, 4-nitroPh, 2-nitroPh, 4-cyanoPh, 2-cyanoPh, 4-formylPh, 4-acetylPh, 4-(ethylthiocarbonyl)Ph, 4-(methoxyethoxycarbonyl)Ph, 4-(methoxyethoxyethoxycarbonyl)Ph, 2,4-dichloroPh, 4-(N-[2-ethylhexyl]aminosulphonyl)Ph, 3,4-dichloroPh, 3-(N,N-dimethylaminosulphonyloxy)Ph, 3-(phenylsulphonyloxy)Ph, 2-nitro-4-chloroPh, 4-(2-ethylhexylaminocarbonyl)Ph, 4-(phenoxysulphonyl)Ph, 4-(fur-2-ylmethoxycarbonyl)Ph, 4-(4-i-propylphenylcarbonyl)Ph, 4-(cyclohexoxycarbonyl)Ph and 2-(nonyloxycarbonyl)Ph.

The $C_{1-12}$-alkyl group represented by Z is preferably not branched in the alpha- or beta-position and is more preferably unbranched. It is preferred that Z is $C_{1-4}$-n-alkyl and, more especially, methyl.

The $C_{2-12}$-alkyl group represented by R is preferably not branched in the alpha- or beta-position. It is preferred that R is $C_{2-6}$-n-alkyl, especially $C_{3-5}$-n-alkyl and more especially n-propyl or n-butyl. Where R represents an interrupted alkyl group this preferably comprises two or more alkyl groups, especially two or three $C_{1-4}$-n-alkyl groups, carrying a total of up to 12 carbon atoms, linked by oxygen atoms. It is especially preferred that the interrupted alkyl represented by R is $C_{1-4}$-alkoxy-$C_{2-4}$-n-alkyl, such as 2-methoxyethyl, 2-ethoxyethyl, 3-ethoxy-n-propyl and 3-n-butoxy-n-propyl. Specific examples of the group represented by R are ethyl, n-propyl, n-butyl, n-pentyl, n-hexyl, n-octyl, 2-ethyl-n-hexyl, 2-methoxyethyl, 2-ethoxyethyl, 3-methoxy-n-propyl, 3-n-butoxy-n-propyl, phenyl and 4-methylphenyl.

It has been found that dyes in which Z and R do not represent alpha- or beta-branched alkyl groups have better light fastness and furthermore that any fading is on shade.

By the term "free from hydrogen atoms capable of intermolecular hydrogen bonding" is meant that the group R is free of "acidic" hydrogen atoms such as are present in —OH and —NH— groups which are capable of forming inter-molecular hydrogen bonds. This restriction does not, however, exclude such groups if their position permits the formation of intra-molecular hydrogen bonds.

The dye of Formula I has particularly good thermal properties giving rise to even prints on the receiver sheet, whose depth of shade is accurately proportional to the quantity of applied heat so that a true grey scale of coloration can be attained.

The dye of Formula I also has strong coloristic properties and good solubility in a wide range of solvents, especially those solvents which are widely used and accepted in the printing industry, for example, alkanols, such a i-propanol & butanol; aromatic hydrocarbons, such as toluene, and ketones such MEK, MIBK and cyclohexanone. This produces inks (solvent plus dye and binder) which are stable and allow production of solution coated dyesheets. The latter are stable, being resistant to dye crystallisation or migration during prolonged storage.

The combination of strong coloristic properties and good solubility in the preferred solvents allows the achievement of deep, even shades on the receiver sheet. The receiver sheets according to the present invention have bright, strong and even yellow shades which are fast to both light and heat.

The Substrate

The substrate may be any convenient sheet material capable of withstanding the temperatures involved in TTP, up to 400° C. over a period of up to 20 milliseconds (msec) yet thin enough to transmit heat applied on one side through to the dye on the other side to effect transfer to a receiver sheet within such short periods, typically from 1–10 msec. Examples of suitable materials are paper, especially high quality paper of even thickness, such as capacitor paper, polyester, polacrylate, polyamide, cellulosic and polyalkylene films, metallised forms thereof, including co-polymer and laminated films, especially laminates incorporating a polyester receptor layer on which the dye is deposited. Such laminates preferably comprise, a backcoat, on the opposite side of the laminate from the receptor layer, of a heat resistant material, such as a thermoseting resin, e.g a silicone, acrylate or polyurethane resin, to separate the heat source from the polyester and prevent melting of the latter during the thermal transfer printing operation. The thickness of the substrate may vary within wide limits depending upon its thermal characteristics but is preferably less that 50 μm and more preferably below 10 μm.

The TTP Process

According to a further feature of the present invention there is provided a transfer printing process which comprises contacting a transfer sheet coated with a dye of Formula I with a receiver sheet, so that the dye is in contact with the receiver sheet and selectively heating areas of the transfer sheet whereby dye in the heated areas of the transfer sheet may be selectively transferred to the receiver sheet.

The transfer sheet is preferably heated to a temperature from 250° C. to 400° C., more preferably above 300° C. and especially around 350° C., for a period of from 1 to 10 milliseconds while it is maintained with the coating in contact with the receiver sheet. The depth of shade of print on any area of the receiver sheet will vary with the time period for which the transfer sheet is heated while in contact with that area of the receiver sheet.

The Receiver Sheet

The receiver sheet conveniently comprises a polyester sheet material, especially a white polyester film, preferably of polyethylene terephthalate (PET). Although some dyes of Formula I are known for the coloration of textile materials made from PET, the coloration of textile materials, by dyeing or printing is carried out under such conditions of time and temperature that the dye can penetrate into the PET and become fixed therein. In thermal transfer printing, the time period is so short that penetration of the PET is much less effective and the substrate is preferably provided with a receptive layer, on the side to which the dye is applied, into which the dye more readily diffuses to form a stable image. Such a receptive layer, which may be applied by co-extrusion or solution coating techniques, may comprise a thin layer of a modified polyester or a different polymeric material which is more permeable to the dye than the PET substrate. While the nature of the receptive layer will affect to some extent the depth of shade and quality of the print obtained it has been found that the dyes of Formula I give particularly strong and good quality prints (e.g. fast to light, heat and storage) on any specific transfer or receiver sheet, compared with other dyes of similar structure which have been proposed for thermal transfer printing. The design of receiver and transfer sheets is discussed further in EP 133,011 and EP 133012.

Examples

The invention is further illustrated by the following examples in which all parts and percentages are by weight unless otherwise indicated.

Ink 1 to Ink 39

These inks were prepared by dissolving a sample of each of the dyes defined in Table 1 (all of Formula I in which Z is methyl unless otherwise indicated) in chloroform to make a solution containing 0.45% of dye followed by sufficient EHEC to give a binder level of 0.9% (dye:binder 1:2).

TABLE 1

| Ink | Dye | Ring A | R |
|---|---|---|---|
| 1 | 1 | 4-chlorophenyl | n-butyl |
| 2 | 2 | 4-chlorophenyl | 2-ethoxyethyl |
| 3 | 3 | 4-chlorophenyl | phenyl |
| 4 | 4 | 4-chlorophenyl | ethyl |
| 5 | 5 | 4-chlorophenyl | n-hexyl |
| 6 | 6 | 4-chlorophenyl | n-propyl |
| 7 | 7 | 4-chlorophenyl | 2-methyl-n-propyl |
| 8 | 8 | 4-chlorophenyl | 2,2,2-trimethylethyl |
| 9 | 9 | 4-chlorophenyl | 2-ethyl-n-hexyl |
| 10 | 10 | 2-chlorophenyl | n-butyl |
| 11 | 11 | 4-(ethylthiocarbonyl) | n-butyl |
| 12 | 12 | 2-fluorophenyl | n-butyl |
| 13 | 13 | 4-fluorophenyl | n-butyl |
| 14 | 14 | 2-nitrophenyl | n-butyl |
| 15 | 15 | 2-nitrophenyl | 2-ethyl-n-hexyl |
| 16 | 16 | 4-formylphenyl | n-butyl |
| 17 | 17 | 4-acetylphenyl | n-butyl |
| 18 | 18 | 2-cyanophenyl | n-butyl |
| 19 | 19 | 4-cyanophenyl | n-butyl |

| Ink | Dye | Substituents on Ring A | R |
|---|---|---|---|
| 20 | 20 | 3,4-dichloro | n-butyl |
| 21 | 21 | 2,4-dichloro | n-butyl |
| 22 | 22 | 2-trifluoromethyl-4-chloro | n-butyl |
| 23 | 23 | 4-(2-[2-methoxyethoxy]ethoxycarbonyl) | ethyl |
| 24 | 24 | 4-(cyclohexyloxycarbonyl) | n-butyl |
| 25 | 25 | 4-(2-ethylhexylaminosulphonyl) | n-butyl |
| 26 | 26 | 2-methoxycarbonyl | n-butyl |
| 27 | 27 | 2-nitro-4-chloro | n-butyl |
| 28 | 28 | 4-(2-[2-methoxyethoxy]ethoxycarbonyl) | n-butyl |
| 29 | 29 | 4-(2-[2-methoxyethoxy]ethoxycarbonyl) | n-octyl |
| 30 | 30 | 4-(2-[2-methoxyethoxy]ethoxycarbonyl) | 2-ethyl-n-hexyl |
| 31 | 31 | 4-(2-[2-methoxyethoxy]ethoxycarbonyl) | n-pentyl |
| 32 | 32 | 4-(2-methoxyethoxycarbonyl) | n-butyl |
| 33 | 33 | 4-(2-methoxyethoxycarbonyl) | ethyl |
| 34 | 34 | 3-nitro-4-chloro | n-butyl |
| 35 | 35 | 3-nitro-4-chloro | ethyl |
| 36 | 36 | 3,4-dichloro | n-butoxy-n-propyl |
| 37 | 37 | 4-benzoyl | n-butyl |

| | | Ring A | R | Z |
|---|---|---|---|---|
| 38 | 38 | lactone | n-butyl | methyl |
| 39 | 39 | 4-chlorophenyl | n-butyl | n-propyl |

Ink 1'

A solution was prepared by stirring 47 g of methyl ethyl ketone (MEK), 31 g of cyclohexanone and 20 g of a 20% solution of EHEC (extra low) in cyclohexanone until homogeneous (about 10 minutes). Then 2 g of Dye 1 were added, the solution was again stirred until the dye had completely dissolved (about 20 minutes at ambient). The ink had a viscosity of 16 seconds (Zahn No. 2 at 20° C.).

Ink 2'

This was prepared by the method of Example 40 except that the Dye 1 was replaced by Dye 2. The ink had the same viscosity as Ink 1'.

Ink 1C to Ink 10C

Inks 1C to 10C were prepared exactly as for Ink 1 except that in each ink the dye was replaced by a dye of the following formula:

II

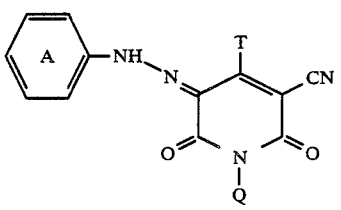

in which Q, T and Ring A are defined in Table 2. In the case of Inks 1C to 6C, each dye was virtually insoluble, even after heating to 40° C. Because the dyes are insoluble they are less desirable for use in TTP processes for the reasons given hereinbefore. Dyes G, H & J, three more comparative dyes of Formula II which fall outside the scope of Formula I, were soluble in the ink medium and inks comprising solutions of the dyes in the solvent could be prepared.

TABLE 2

| Ink | Dye | Ring A | Q | T |
|---|---|---|---|---|
| 1C | A | 2-chlorophenyl | methyl | methyl |
| 2C | B | 2-trifluoromethylphenyl | methyl | methyl |
| 3C | C | 3,4-dichlorophenyl | methyl | methyl |
| 4C | D | 4-chlorophenyl | benzyl | methyl |
| 5C | E | 4-chlorophenyl | 2-hydroxyethyl | methyl |
| 6C | F | 2-fluorophenyl | methyl | methyl |
| 7C | G | 4-chlorophenyl | n-butyl | i-propyl |
| 8C | H | 4-chlorophenyl | i-propyl | methyl |
| 9C | J | 4-chlorophenyl | 1-methylpropyl | methyl |
| 10C | K | 4-chlorophenyl | allyl | methyl |

Ink 11C

A solution was prepared by stirring 47 g MEK, 31 g of cyclohexanone and 20 g of a 20% solution of EHEC (extra low) in cyclohexanone together until homogeneous (about 10 minutes). Then 2 g of Dye A was added. The dye was almost completely out of solution, even after stirring for 30 minutes at 40° C.

Ink 12C

An ink was prepared according to the method for Ink 42 except that Dye A was replaced by Dye B. The dye was also almost completely out of solution even after heating to 40° C.

EXAMPLE 1

A transfer sheet, hereinafter called TS1, was prepared by applying Ink 1 to a 6 micron sheet of polyethylene terephthalate using a wire-wound metal Mayr-bar to produce a 2 micron layer of ink on the surface of the sheet. The ink was dried with hot air.

EXAMPLES 2 TO 41

A further 40 transfer sheets in accordance with the present invention, transfer sheets TS1', TS2, TS2' and TS3 to TS39, were prepared according to the procedure of Example 1 using Ink 1, Ink 2, Ink 2' and Ink 3 to Ink 39, respectively, in place of Ink 1.

Transfer Sheets TS1C to TS12C

A further 11 comparative transfer sheets, transfer sheets TS1C to TS12C were prepared according to the procedure of Example 1 using Ink 1C to Ink 12C in place of Ink 1.

EXAMPLE 42

A sample of TS 1 was sandwiched with a receiver sheet, comprising a composite structure based on a white polyester base having a copolyester receptor surface with the receptor surface of the latter in contact with the printed surface of the former. The sandwich was placed on the drum of a transfer printing machine and passed over a matrix of closely-spaced pixels which were selectively heated in accordance with a pattern information signal to a temperature of >300° C. for a period of 2–10 msec, whereby the dye at the position on the transfer sheet in contact with a pixel while it is hot is is transferred from the transfer sheet to the receiver sheet. After passage over the array of pixels the transfer sheet was separated from the receiver sheet The printed receiver sheet is hereinafter referred to as RS 1.

EXAMPLES 43 TO 83

The procedure of Example 1 was repeated using each of TS1', TS2, TS2' and TS3 to TS39 in place of TS 1 and the printed receiver sheets are hereinafter referred to as RS1', RS1' RS2' and RS3 to RS39.

Receiver Sheets RS1C to RS12C

The procedure of Example 42 was repeated using each of TS 1C to TS12C in place of TS 1 and the printed receiver sheets are hereinafter referred to as RS1C to RS12C.

Assessment of Dyes, Inks, Transfer & Receiver Sheets

The absorption maxima ($WL_{max}$) and extinction coefficients ($EC_{max}$) of the dyes, the stability of the inks and the transfer sheets and the quality of the prints on the receiver sheets were assessed. The inks were assessed by visual inspection, microscopy and viscosity; the dyesheets by visual inspection and microscopy both before and after temperature cycling tests to assess the presence of dye crystallisation and/or migration; and the printed impression on the receiver sheet was assessed in respect of reflection density of colour by means of a densitometer (Sakura Digital densitometer) and for light fastness by means of a xenon fadeometer, against blue scale standards 1–8; 1 indicating poor fastness and 8 indicating excellent fastness.

The results of the assessments are set out in Table 3.

TABLE 3

| Dye/TS/RS | Dye $WL_{max}$ | Dye $EC_{max}$ | Ink Stability | TS Stability | RS OD | RS LF |
|---|---|---|---|---|---|---|
| 1/1/1 | 439 | 41,250 | Excellent | Very good | 1.5 | 4–5 |
| 1/1'/1' | 439 | 41,250 | Excellent | Very good | 2.1 | 4–5 |
| J/9C/9C | 439 | 44,760 | Excellent | Very good | 1.4 | 2–3 |
| 2/2/2 | 439 | 43,130 | Excellent | Good | 1.4 | 4–5 |
| 2/2'/2' | 439 | 43,130 | Excellent | Good | 2.0 | 4–5 |
| E/5C/5C | 441 | 45,320 | Very poor | Poor | 0.5 | 3 |
| 3/3/3 | 440 | 41,930 | Excellent | Good | 1.4 | 4 |
| D/4C/4C | 441 | 42,040 | Very poor | Poor | 1.0 | 2 |
| 4/4/4 | 442 | 41,930 | Excellent | Very good | 1.45 | 4–5 |
| E/5C/5C | 441 | 45,320 | Very poor | Poor | 0.5 | 3 |
| 5/5/5 | 439 | 38,400 | Excellent | Very good | 1.5 | 6 |
| 6/6/6 | 439 | 48,000 | Good | Good | 1.5 | 4 |
| H/8C/8C | 436 | 47,000 | Good | Good | 1.5 | 2–3 |
| K/10C/10C | 438 | 47,230 | Good | Good | 1.6 | 2–3 |
| 7/7/7 | 439 | 43,136 | Good | Good | 1.1 | 3–4 |
| 8/8/8 | 438 | 42,140 | Good | Good | 1.5 | 3–4 |
| 9/9/9 | 439 | 45,096 | Moderate | Moderate | 1.5 | 3 |
| 10/10/10 | 435 | 43,140 | Good | Good | 1:4 | 4 |
| A/1C/1C | 435 | 43,550 | Very poor | Poor | 0.69 | 5 |
| 11/11/11 | 438 | 48,448 | Very good | Very good | 2.2 | 4 |
| 12/12/12 | 433 | 40,524 | Excellent | Very good | 1.5 | 5 |
| F/6C/6C | 433 | 41,849 | Poor | Poor | 1.2 | 5–6 |
| 13/13/13 | 435 | 40,100 | Good | Good | 1.3 | 4 |
| 14/14/14 | 436 | — | Good | Moderate | 1.8 | 5 |
| 15/15/15 | 436 | — | Good | Moderate | 1.2 | 5 |
| 16/16/16 | 435 | 50,800 | Very good | Very good | 2.3 | 5 |
| 17/17/17 | 436 | 38,400 | Very good | Very good | 2.5 | 5 |
| 18/18/18 | 422 | 44,100 | Good | Good | 2.1 | 4–5 |
| 19/19/19 | 427 | — | Very good | Very good | 2.3 | 5 |
| 20/20/20 | 436 | 44,200 | Good | Good | 1.3 | 4–5 |
| C/3C/3C | 436 | 40,437 | Very poor | Poor | 1.1 | 4 |
| 21/21/21 | 439 | 37,990 | Good | Good | 1.0 | 4 |
| 22/22/22 | 427 | 42,300 | Moderate | Moder-ate- | 1.1 | 5 |
| B/2C/2C | 415 | 41,000 | Very poor | Poor | 1.0 | 4–5 |
| 23/23/23 | 434 | 44.300 | Excellent | Very good | 1.3 | 5–6 |
| 24/24/24 | 434 | 46,004 | Excellent | Very good | 1.2 | 4 |
| 25/25/25 | 428 | — | Good | Good | 0.9 | 4–5 |
| 26/26/26 | 430 | 43,089 | Good | Good | 2.1 | 5 |
| 27/27/27 | 442 | — | Good | Good | 1.8 | 5 |
| 28/28/28 | 434 | 43,760 | Very good | Excellent | 1.6 | 4–5 |
| 29/29/29 | 435 | 44,100 | Good | Moderate | 1.4 | 3–4 |
| 30/30/30 | 434 | 43,510 | Good | Moderate | 1.5 | 3–4 |
| 31/31/31 | 434 | 43,960 | Good | Good | 1.6 | 4 |
| 32/32/32 | 435 | 44,100 | Excellent | Excellent | 1.6 | 4–5 |
| 33/33/33 | 436 | 43,240 | Good | Excellent | 2.1 | 4–5 |
| 34/34/34 | 427 | 43,766 | Good | Moderate | 1.7 | 3–4 |
| 35/35/35 | 427 | 43,731 | Good | Good | 1.8 | 3–4 |
| 36/36/36 | 436 | 42,134 | Good | Good | 1.7 | 4 |
| 37/37/37 | 438 | — | Good | Good | 1.8 | 3–4 |
| 38/38/38 | 426 | — | Good | Good | 1.6 | 3–4 |
| 39/39/39 | 438 | 40,786 | Excellent | Good | 2.0 | 4 |
| G/7C/7C | 439 | 40,183 | Excellent | Good | 2.0 | 2 |
| A/11C/11C | 435 | 41,550 | Very poor | Poor | 0.6 | 5 |
| B/12C/12C | 415 | 41,000 | Very poor | Poor | 0.9 | 5–6 |

These results show that azopyridone dyes of Formula I are eminently suitable yellow dyes for TTP, but that not all azopyridone yellow dyes are suitable. Thus, the comparative dyes, Dyes A to F, have poor solvent solubility and therefore give poor inks (Inks 1C to 6C, 11C and 12C). The stabilities of the resulting transfer sheets (TS1C to TS6C, TS11C and TS12C) are generally poor and Dyes A to F have thermochemical profiles which generally result in lower optical densities of the printed impressions on the receiver sheets (RS1C to RS6C, RS11C and RS12C). A comparison of Dye G and Dye 39, Dye H and Dye 6 and Dye J and Dye 1 demonstrates that in each pair, the latter dye, in accordance with Formula I, has superior lightfastness to the former dye, which lies outside the scope of Formula I because the alkyl substituent in the 1 or the 4 position is alpha-branched.

We claim:

1. A thermal transfer printing sheet comprising a substrate having a coating comprising a binder and a dye of the formula:

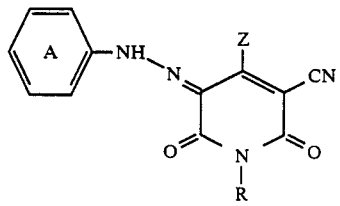

wherein

Ring A is unsubstituted or carries, in the 2- or 4-position with respect to the azo link, at least one group selected from $—CX_3$, $X^1$, CN, $NO_2$, —OCO.Y, —CO.Y, —CO.H, $—OSO_2.Y$ and $—SO_2.Y$, provided that A is substituted when Z is $CH_3$ and R is $C_{2-4}$-alkyl;

X & $X^1$ are each independently halogen;

Y is selected from $R^1$, $—OR^1$, $SR^1$ and $—NR^1R^2$;

$R^1$ is selected from $C_{1-12}$-alkyl, $C_{1-12}$-alkyl interrupted by one or two groups selected from —O—, —CO—, O.CO— and —CO.O—, $C_{3-7}$-cycloalkyl, mono- or bi-cyclic aryl and $C_{1-3}$-alkylene attached to an adjacent carbon atom on Ring A;

$R^2$ is selected from H, $C_{1-12}$-alkyl, $C_{3-7}$-cycloalkyl and mono- or bi-cyclic aryl;

Z is $C_{1-12}$-alkyl or phenyl; and

R is selected from $C_{2-12}$-alkyl unbranched in the alpha-position,, $C_{2-12}$-alkyl unbranched in alpha-position and interrupted by one or two groups selected from —O—, —CO—, O.CO— and —CO.O—, phenyl, $C_{1-4}$-alkylphenyl, biphenyl and biphenyl interrupted by a group selected from —O—, —CO—, O.CO— and —CO.O—, each of which is free from hydrogen atoms capable of intermolecular hydrogen bonding.

2. A thermal transfer printing sheet according to claim 1 wherein in the defined dye:

Ring A carries one or two substituents in the 2, 4 or 2 and 4 positions selected from $—CF_3$, F, Cl, CN, $NO_2$, —OCO.Y, —CO.Y, CO.H, $—OSO_2.Y$ and $—SO_2.Y$;

Y is selected from $R^1$, $—OR^1$, $SR^1$ and $—NR^1R^2$;

$R^1$ is selected from $C_{1-12}$-alkyl, a chain of two or three $C_{1-4}$-alkyl group, containing a total of up to 12 carbon atoms, linked by groups selected from —O—, —CO—, O.CO— and —CO.O—, $C_{3-7}$-cycloalkyl, phenyl and $C_{1-3}$-alkylene attached to an adjacent carbon atom on Ring A;

$R^2$ is selected from $C_{1-12}$-alkyl, $C_{3-7}$-cycloalkyl and phenyl;

Z is $C_{1-4}$-n-alkyl; and

R is selected from $C_{2-6}$-n-alkyl, phenyl and a chain of two or three $C_{1-4}$-alkyl groups, containing a total of up to 12 carbon atoms, linked by —O— bridging groups.

3. A thermal transfer printing sheet according to claim 1 or claim 2 wherein in the defined dye:

Ring A carries a substituent in the 2 or 4 position selected from F, Cl, CN, $NO_2$, —CO.Y and —CO.H;

Y is selected from $R^1$, —$OR^1$, —$SR^1$;

$R^1$ is $C_{1-4}$-alkyl or a chain of two or three $C_{1-4}$-alkyl group, containing a total of up to 12 carbon atoms, linked —O— groups;

4. A thermal transfer printing sheet according to claim 1, wherein in the defined dye:

Ring A is selected from 4-chlorophenyl, 2-fluorophenyl, 2-nitrophenyl, 2-nitro-4-chlorophenyl, 2-cyanophenyl, 4-cyanophenyl, 4-formylphenyl, 4-acetylphenyl, 2-methoxycarbonylphenyl, 4-(2-methoxyethoxycarbonylphenyl) and 4-ethylthiocarbonylphenyl;

Z is methyl; and

R is $C_{2-6}$-n-alkyl or $C_{1-4}$alkoxy-$C_{2-4}$-n-alkyl.

5. A thermal transfer printing sheet according to claim 1 wherein R is n-propyl or n-butyl.

6. A transfer printing process which comprises contacting a transfer sheet according to claim 1 with a receiver sheet, so that the dye is in contact with the receiver sheet and selectively heating areas of the transfer sheet whereby dye in the heated areas of the transfer sheet may be transferred to the receiver sheet.

7. A transfer printing process according to claim 6 wherein the transfer sheet is heated to a temperature from 300° C. to 400° C. for a period from 1 to 10 milliseconds while in contact with the receiver sheet.

8. A transfer printing process according to claim 6 wherein the receiver sheet is white polyester film.

9. A thermal transfer printing sheet comprising a substrate having a coating comprising a binder and a dye of the formula:

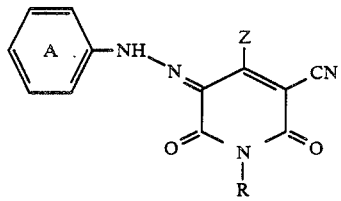

wherein

Ring A is unsubstituted or carries one or two substituents selected from —$CX_3$, $X^1$, CN, $NO_2$, —OCO.Y, —CO.Y, —$OSO_2$.Y and —$SO_2$.Y, provided that A is substituted when Z is $CH_3$ and R is $C_{2-4}$-alkyl;

X & $X^1$ are each independently halogen;

Y is selected from $R^1$, —$OR^1$ and —$NR^1R^2$;

$R^1$ is selected from $C_{1-12}$-alkyl, $C_{1-12}$-alkyl interrupted by a bridging group selected from —O—, —CO—, O.CO— and —CO.O—, $C_{3-7}$-cycloalkyl and mono- or bi-cyclic aryl;

$R^2$ is selected from H, $C_{1-12}$-alkyl, $C_{3-7}$-cycloalkyl and mono- or bi-cyclic aryl;

Z is $C_{1-12}$-alkyl; and

R is selected from phenyl, $C_{2-12}$-alkyl unbranched in the alpha- and beta-positions, $C_{2-12}$-alkyl unbranched in alpha- and beta-positions and interrupted by an —O— bridging group.

* * * * *